United States Patent [19]

Lew

[11] Patent Number: 4,824,019

[45] Date of Patent: Apr. 25, 1989

[54] LAWN-BORDER SPRINKLER

[76] Inventor: Hyok S. Lew, 7890 Oak St., Arvada, Colo. 80005

[21] Appl. No.: 488,195

[22] Filed: Apr. 25, 1983

Related U.S. Application Data

[63] Continuation-in-part of Ser. No. 272,326, Jun. 10, 1981, abandoned.

[51] Int. Cl.[4] ..... B05B 15/06

[52] U.S. Cl. ..... 239/201; 239/266; 239/279; 239/450; 239/562

[58] Field of Search ..... 239/200, 201, 202, 207, 239/266, 269, 273, 279, 450, 559, 562–564, 566, 567, DIG. 1

[56] References Cited

U.S. PATENT DOCUMENTS

| | | | |
|---|---|---|---|
| 2,339,632 | 1/1944 | Folsom | 239/567 |
| 2,909,328 | 10/1959 | Babyak | 239/567 |
| 3,361,359 | 1/1968 | Chapin | 239/269 |
| 3,387,786 | 6/1968 | Rynberk | 239/201 |
| 3,485,449 | 12/1969 | Wilson | 239/200 |
| 3,672,571 | 6/1972 | Goodricke | 239/269 |
| 3,773,059 | 11/1973 | Arneson | 239/563 |
| 3,874,598 | 4/1975 | Havens | 239/450 |
| 4,162,041 | 7/1979 | Hane | 239/266 |
| 4,235,380 | 11/1980 | Delmer | 239/450 |

FOREIGN PATENT DOCUMENTS

| | | | |
|---|---|---|---|
| 1422293 | 11/1965 | France | 239/200 |
| 174558 | 4/1935 | Switzerland | 239/279 |

*Primary Examiner*—Andres Kashnikow
*Assistant Examiner*—Michael Forman

[57] ABSTRACT

This invention relates to an automatic sprinkler system for watering the lawn or vegetable gardens. The lawn-border sprinkler comprises a longitudinal member including a plurality of conduits, disposed in a parallel configuration wherein the top most conduit is divided into a plurality of separate compartments, each of which compartments includes a series of minute holes through the wall of the conduit. Each of the compartments in the top-most conduit is connected to separate supply conduit comprising an exclusive combination of said plurality of the conduits disposed parallel to the top-most compartment; whereby, a manifold valve controlling the water flow through each of the supply conduit supplying the water to each of the compartments with sprinkling holes controls the time-wise sprinkling pattern of each of the sprinkling compartments.

4 Claims, 2 Drawing Sheets

LAWN-BORDER SPRINKLER

This is a continuation-in-part application to a patent application Ser. No. 272,326 entitled "Lawn-Border Sprinkler" filed on June 10, 1981, abandoned.

The present-day sprinkler markets provides two different types of sprinkler system: The well-known automatic sprinkler system employing a plurality of the sprinkler heads each of which is supplied with water by a separate conduit; and the portable sprinklers such as the crawling sprayer or the twin plastic tubing with a series of minute holes through its wall. The automatic sprinkler system with a plurality of the sprinkler heads is widely used because of the convenience to users provided by the permanently installed system operated in an automated mode. However, said automatic sprinkler system has a few shortcomings in that firstly, it is an expensive system to install and secondly, it is less than efficient and economic watering system in saving the water which is increasingly becoming an expensive commodity. The portable water sprinkling system is never a substitute for the automatic sprinkler system because it has to be tended by a person during its operation. Therefore, there is a need for a fully automatic new sprinkler system that is inexpensive to install and more economic in watering.

SPECIFICATION

The primary object of the present invention is to provide an automatic sprinkler system that operates without any separate sprinkler heads, which sprinkler system is for a permanent installation.

Another object of the present invention is to provide an automatic sprinkler system that functions as the lawn-border, which can be readily retrofitted to existing lawn without digging it up all over.

A further object of the present invention is to provide a sprinkler system that works as an active sprinkler or as a drip watering system.

Yet another object of the present invention is to provide an automatic sprinkler system that is inexpensive and easy to install.

Still a further object of the present invention is to provide an automatic sprinkler system that requires a minimum amount of controls.

These and other objects of the present invention will become clear as the description of the present invention proceeds. The present invention may be described with a greater clarity and specificity by referring to the following Figures.

Figure 1:
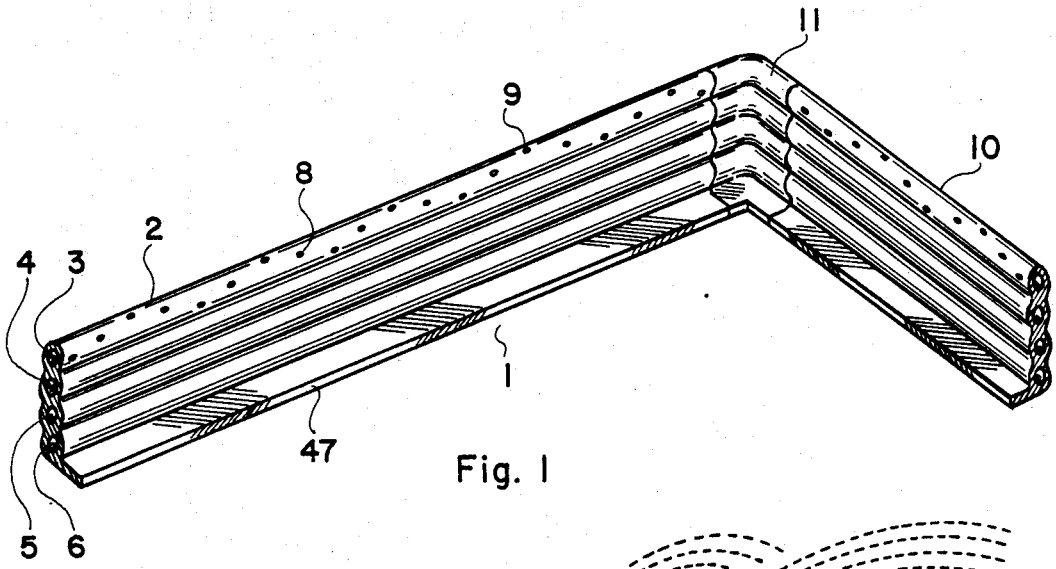
FIG. 1 illustrates a perspective view of the a segment of the lawn-border sprinkler constructed in accordance with the principles of the present invention.

In FIG. 1, there is shown a perspective view of the lawn-border sprinkler constructed in accordance with the principles of the present invention. The lawn-border sprinkler 1 comprises the border leg 2 including the sprinkling conduit 3 which is the top-most conduit and a plurality of supplying conduits 4,5,6, etc disposed parallel to the sprinkling conduit 1, and the anchoring leg 47 extending from the foot of the border leg 2 at 90 degree angle. The sprinkling conduit 3 includes a plurality of minute holes 8 disposed through its wall along its length, which plurality of minute holes are disposed at various angular positions in order to throw the water jets at various angles; whereby, the water jets with different trajectory lands at various distances from the lawn-border sprinkler. This matter will be discussed further in conjunction with FIG. 2. The sprinkling conduit 3 is divided into a plurality of separate compartments, each of which compartments is supplied by each of the exclusive combinations of the supplying conduits 4,5,6, etc. The straight runs 9 and 10 of the lawn-border sprinkler may be connected to one another by the angled fittings 11. Of course, it is not difficult to realize that a lawn-border sprinkler can be branched into two branches by using a Tee-fittings. It should be understood that the straight run of the lawn-border sprinkler may comprise a plurality of longitudinal members connected to each other by the special connecting members providing a combination of exclusive supply routes to each of the separate compartments in the sprinkling conduit. It should be further understood that the anchoring leg 7 is a component which has no function in the operation of the lawn-border sprinkler other than providing a means for securely anchoring the lawn-border sprinkler into the ground. Therefore, the lawn-border sprinkler may be constructed without the anchoring leg 7 or with anchoring leg of different designs. It is a matter of design to dispose the plurality of the supplying conduits parallel to the sprinkling conduit in a configuration such as that shown in FIG. 1 or in any other configurations which differ from the illustrative embodiment shown in FIG. 1. For example, the supplying conduits may be disposed in double columns instead of single column as shown.

Figure 2:
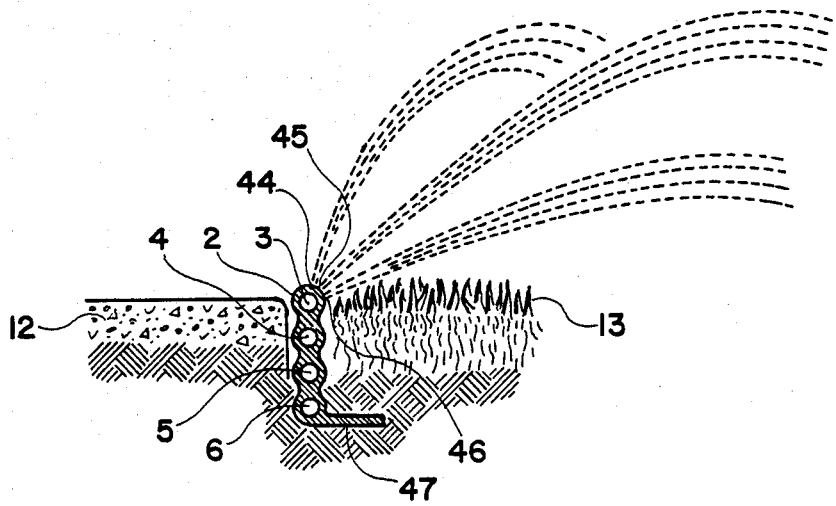
FIG. 2 illustrates a cross section of the lawn-border sprinkler taken along a plane perpendicular to the central axis of the conduits included in the lawn-border sprinkler.

In FIG. 2, there is shown a cross section of the lawn-border sprinkler shown in FIG. 1, which cross section is taken along a plane perpendicular to the axis of the sprinkling conduit 3 and the supplying conduits 4,5,6, etc. The border leg 2 provides a lawn-border barrier that separates the lawn 13 from the pavement 12, while the anchoring leg 7 is buried under dirts. The plurality of the minute holes 8 disposed through the wall of the sprinkling conduit 2 comprises three different groups: The first group of minute holes 44 are disposed close to a vertical plane to provide the water jets for the short range sprinkling. The second group of the minute holes 45 are disposed substantially to the 45 degree plane to provide the water jets for the long range sprinkling. The third group of the minute holes 46 are disposed on a plane intermediate the 45 degree plane and the horizontal plane for the medium range sprinkling. The combination of three groups of the minute holes provide a uniform watering of the lawn.

Figure 3:
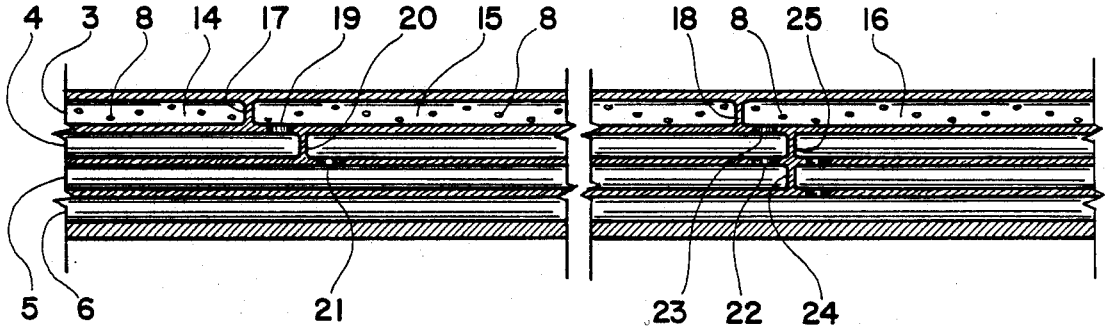
FIG. 3 illustrates a cross section of the lawn-border sprinkler taken along a plane including the central axis of the conduits included in the lawn-border sprinkler.

In FIG. 3, there is shown a cross section of the lawn-border sprinkler 1 taken along a plane including the central axis of the sprinkling conduit 3 and the plurality of the supplying conduits 4,5,6, etc. The sprinkling conduits 3 is divided into a series of separate compartments 14,15,16, etc., by a plurality of blockages 17,18, etc. The compartment 14 is supplied with water directly through the sprinkling conduit 3. The compartment 15 is supplied through the supplying conduit 4 which is open to the compartment 15 by the flow path-switching port 19. The supplying conduit 4 is blocked by a blockage 20 blocking the flow path at a down stream of the flow-path-switching port 19. The compartment 16 is supplied through the supplying conduit 5 which is open to the supplying conduit 4 at the down stream of the blockage 20 through a pair of flow path-switching ports 21 and 22 wherein the water flows to the compartment 16 through the flow path-switching port 23. The supplying conduit 6, which utilizes the supplying conduits 4 and 5 after the blockages 24 and 25, supplies the water to the sprinkling compartment downstream of the sprinkling compartment 16.

With the construction of the lawn-border sprinkler 1 as shown in FIGS. 1, 2, and 3, the lawn-border sprinkler 1 operates in the following principles: The manifold valve installed at the upstream end of the lawn-border sprinkler 1 and connected to the water supply pipe allows the water to flow into one supplying conduit at one time at the upstream end of the lawn-border sprinkler; whereby, only one of the sprinkling compartment included in the sprinkling conduit sprays water onto the lawn at a given time. As the manifold valve cycles the water supply to different supplying conduits connected to said manifold valve, different sprinkling compartments spray in a cyclic pattern in time, which mode of the operation is exactly the same as the conventional automatic sprinkler system with a plurality of independent sprinkling head supplied by separate conduits. It should be understood that the compartmentizing of the sprinkling conduit is required because the pressure and volume of the water supply from the water pipe is limited and, consequently, the entire length of the sprinkling conduit can not be operated at the same time. Therefore, it is necessary to operate one sprinkling compartment at one time in a cyclic fashion in time frame. The length of each of the sprinkling compartment is determined by the available water pressure in the water supply pipe and the maximum distance the water jets have to travel.

In terms of the facility in manufacturing and the convenience in transporting and installing it is generally not preferred to construct the lawn-border sprinkler as shown in FIG. 3 in one single piece. The complex structure of the lawn-border sprinkler shown in FIG. 3 can be obtained by combining a few components which have very simple construction. The lawn-border sprinkler of FIG. 3 can be constructed by using a plurality of longitudinal members including a sprinkling conduit and a plurality of supplying conduits, and a plurality of the connecting members of a few different types connecting the longitudinal members to each other.

Figure 4:
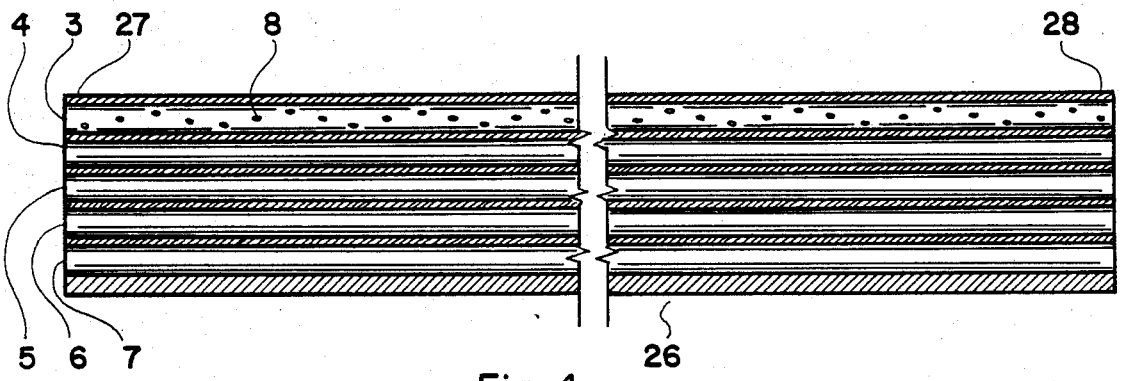
FIG. 4 illustrates a cross section of the longitudinal member included in the lawn-border sprinkler.

In FIG. 4, there is shown a cross section of the longitudinal member 26 which cross section is taken along a plane including the central axis of the sprinkling conduit 3 and the supplying conduits 4,5,6,7, etc., all of which conduits are straight-through conduits without any blockage. The sprinkling conduits 3 includes a plurality of the minute holes disposed through its wall, which plurality of fine holes may comprise a single family or many different families of holes providing different trajectory for the water jets.

Figure 5:
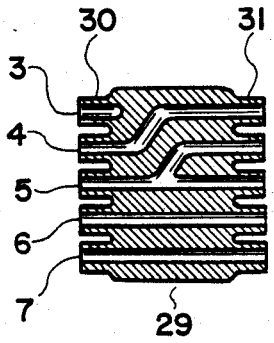
FIG. 5 illustrates a cross section of a connecting member included in the lawn-border sprinkler.

In FIG. 5, there is shown a cross section of a connecting member 27 which is employed to block the sprinkling conduit 3 and to switch the flow path from the supplying conduit 4 to the sprinkling conduit 3 at the downstream of the blockage of the sprinkling conduit 3. The supplying conduit 5 takes over the supplying conduit 4 at the downstream of the blockage of the supplying conduit 4, while the supplying conduits 6 and 7 remain unaltered. The extremities 30 and 31 of the connecting member 29 is formed to mate with the extremities of the longitudinal member 26. The upstream extremity 30 of the connecting member 29 is connected to the downstream extremity 28 of the longitudinal member 26, while the downstream extremity 31 of the connecting member 29 is connected to the upstream extremity 27 of another longitudinal member 26.

Figure 6:
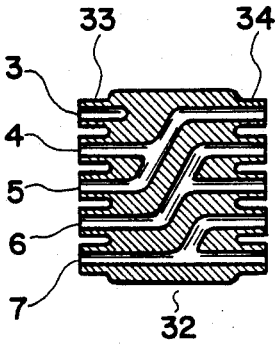
FIG. 6 illustrates another connecting member included in the lawn-border sprinkler.

In FIG. 6, there is shown another connecting member 32 which blocks the sprinkling conduit 3, switches conduits 4 and 5 to the sprinkling conduit at the downstream of the blockage of the sprinkling conduit, switches the supplying conduit 6 to the supplying conduits 4 and 5 and switches the supplying conduit 7 to the supplying conduits 5 and 6. The upstream extremity 33 is connected to the downstream extremity of the longitudinal member of which upstream extremity is connected to the downstream extremity 31 of the connecting member 29. The downstream extremity 34 of the connecting member 32 is connected to a further longitudinal member.

Figure 7:
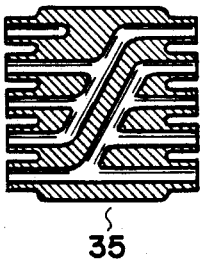
FIG. 7 illustrates a further connecting member included in the lawn-border sprinkler.

In FIG. 7, there is shown a further connecting member 35 which is connected to the longitudinal member connected to the connecting member 32.

Figure 8:
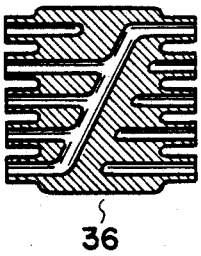
FIG. 8 illustrates yet another connecting member included in the lawn-border sprinkler.

In FIG. 8, where is shown still another connecting member 36 that is to be connected to the last longitudinal member in one line of lawn-border sprinkler. The connecting members such as those shown in FIGS. 5, 6, 7 and 8 connecting the longitudinal members such as that of FIG. 4 enables to construct the assembly of the lawn-border sprinkler shown in FIG. 3. The connecting members shown in FIGS. 5, 6, 7 and 8 are only a few examples of such connecting members as many different flow-switching circuits can be incorporated into each of the great variety of the flow-switching fittings.

Figure 9:
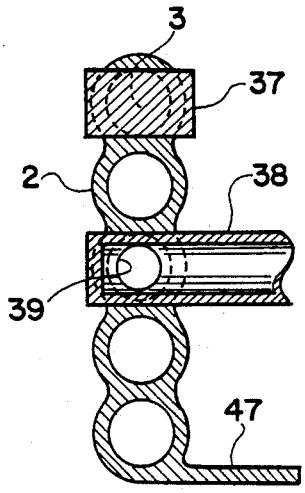
FIG. 9 illustrates a cross section of the lawn-border sprinkler taken along a plane perpendicular to the central axis of the sprinkling and supply conduits, which shows another means for compartmentizing the sprinkling conduits and branching-off the supplying conduits.

In FIG. 9, there is shown a cross section of the lawn-border sprinkler taken along a plane perpendicular to the central axis of the sprinkling conduit and the supplying conduits; wherein another method for compartmentizing the sprinkling conduit and blocking the supplying conduits is shown. The sprinkling conduit 3 is compartmentized by the blocking plug 37 of a solid cylindrical geometry, which is press-fitted into a hole bored through the central axis of the sprinkling conduit in 90 degree angle. It can be easily recognized that such a blocking plug can be also used to block the supplying conduits in switching the flow from one of the supplying conduits to the sprinkling conduit or to another supplying conduit. The conduit 38 with a closed end, which is press-fitted into a hole bored through the central axis of a supplying conduit in the 90 degree angle, is employed to tee-off or tee-in said supplying conduit. The branching conduit 38 includes a port 39 through its wall disposed near the closed end of the branching conduit, which port allows the water to flow into the supplying conduit from the branching conduit or to flow out from the supplying conduit to the branching conduit.

Figure 10:
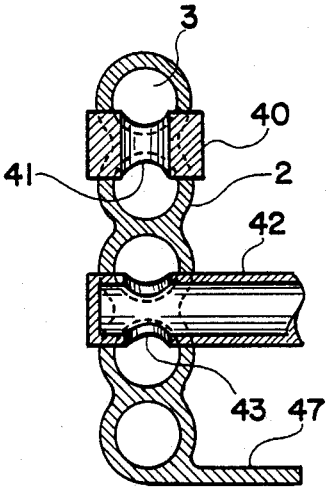
FIG. 10 illustrates a further means for switching the flow paths in the supplying conduits and branching off the supply conduits.

In FIG. 10, there is shown another cross section of the lawn-border sprinkler including a flow path-switching plug 40 including a through hole 41 bored through the central axis of said flow path-switching plug in 90 degree angle, which plug is press-fitted into a hole bored through the border leg of the lawn-border sprinkler intermediate two adjacent conduits. Of course, the through hole 41 switches flow from a supplying conduit to the sprinkling conduit as shown in FIG. 10 or switches flow from one supplying conduit to another supplying conduit. The branching conduit 42 with a closed end, which is press-fitted into a hole bored through the border leg of the lawn-border sprinkler intermediate two adjacent supplying conduits, tee-off or tee-in both of two adjacent supplying conduits. The branching conduit 42 includes a through hole 43 bored through its central axis in 90 degree angle, which through hole connects the branching conduit simultaneously to the pair of adjacent supplying conduits. It is now clear that a lawn-border sprinkler such as that shown in FIG. 3 can be constructed by using the longitudinal member 26 as shown in FIG. 4 and an appropriate combination of the blocking plugs 37 as illustrated in FIG. 9 and the flow-switching plugs 40 as shown in FIG. 10, which provides an alternate method for constructing a lawn-border sprinkler.

While the principles of the invention have now been made clear by the illustrative embodiments, there will be immediately obvious to those skilled in the art many modifications of the structures, arrangements, proportions, the elements, materials and components used in the practice of the invention which are particularly adapted for specific environments and operating requirements without departing from those principles.

I claim:

1. A lawn-border sprinkler for watering a lawn or vegetable garden comprising in combination:

(a) at least one sprinkling conduit including a plurality of minute holes through a wall of said sprinkling conduit disposed along the length of said sprinkling conduit, said sprinkling conduit divided into a plurality of separate compartments; and (b) a plurality of supplying conduits disposed parallel to said sprinkling conduit, each of said plurality of supplying conduits including a plurality of blockages blocking a flow path through said each of supplying conduits at various sections and a plurality of flow path-switching ports connecting said each of plurality of the supplying conduits to another of said plurality of the supplying conduits adjacent to said each of plurality of supplying conduits or various sections wherein said plurality of the blockages and said plurality of flow path-switching ports provide a plurality of mutually exclusive routes through said plurality of supplying conduits, each of said mutually exclusive routes supplying the water to each of said plurality of separate compartments included in said sprinkler conduit;

whereby, a manifold valve connected to said sprinkling conduit and to said plurality of supplying conduits at the upstream end of said lawn-border sprinkler supplies the water to one of said plurality of separate compartments included in said sprinkling conduit at one time in a sequential manner.

2. The combination as set forth in claim 1 wherein said at least one sprinkling conduit and said plurality of supplying conduits constitutes a lawn-border barrier separating grass in the lawn from a side-walk or other adjacent area from the lawn.

3. The combination as set forth in claim 2 wherein said lawn-border barrier comprising said at least one sprinkling conduit and said plurality of the supplying conduits includes an anchoring leg extending from a foot of said lawn border barrier in a substantially perpendicular angle.

4. A lawn border sprinkler for watering a lawn and vegetable garden comprising in combination:

(a) a plurality of longitudinal members, each of said plurality of longitudinal members including at least one sprinkling conduit with a plurality of minute holes through a wall of said sprinkling conduit disposed along a length of said sprinkling conduit; and a plurality of supplying conduits disposed parallel to said sprinkling conduit; and (b) a plurality of connecting members, each of said plurality of connecting members connecting one of said longitudinal members to another of said longitudinal members in substantially leak-proof manner, each of said connecting members including a blockage blocking flow path through said sprinkling conduit and further including at least one flow path-switching port inter-connecting at least two of said plurality of the supplying conduits respectively disposed through said one and another of said longitudinal members in a shifting relationship wherein said plurality of the connecting members and said plurality of the longitudinal members in combination provide a plurality of mutually exclusive routes supplying the water separately to each of said sprinkling conduits included in each of said plurality of the longitudinal members; whereby, a manifold valve connected to said sprinkling conduit and to said plurality of supplying conduits at the upstream end of said lawn-border sprinkler supplies the water to one of said sprinkling conduits included in each of said plurality of the longitudinal members at one time in a sequential manner.

* * * * *